United States Patent [19]

Bui et al.

[11] Patent Number: 4,468,131

[45] Date of Patent: Aug. 28, 1984

[54] ELECTRONIC WATCH HAVING A NON-MOVING MEANS OF CONTROL

[75] Inventors: Ngoc C. Bui, Neuchâtel; Daniel Simonet, Perly-Certoux, both of Switzerland

[73] Assignee: Asulab S.A., Bienne, Switzerland

[21] Appl. No.: 374,018

[22] Filed: May 3, 1982

[51] Int. Cl.[3] ..... G04C 17/00; G04B 19/00

[52] U.S. Cl. ..... 368/69; 368/224

[58] Field of Search ..... 368/69–70, 368/155, 185, 187, 188, 234, 319–334; 307/117

[56] References Cited

U.S. PATENT DOCUMENTS 4,091,612 5/1978 Meisner et al. ..... 368/155

FOREIGN PATENT DOCUMENTS 0031077 7/1981 European Pat. Off. .

2855935 7/1979 Fed. Rep. of Germany .

7432419 4/1976 France .

*Primary Examiner*—Vit W. Miska

*Attorney, Agent, or Firm*—Spensley, Horn, Jubas & Lubitz

[57] ABSTRACT

An electronic watch having a case and a case back, a digital display, an integrated circuit, a battery and a fixed photo-electric pick-off placed on the module facing a window. The pick-off is for preference a photodiode and its functioning is controlled by obstructing with a finger the window so as to prevent the ambient light from lighting the pick-off. According to the invention, the control system of the watch has the advantage of being insensitive to electrical parasites, of consuming little current, of being only slightly dependent upon the intensity of ambient light and of being simple to fabricate.

13 Claims, 9 Drawing Figures

ELECTRONIC WATCH HAVING A NON-MOVING MEANS OF CONTROL

BACKGROUND OF THE INVENTION

The present invention concerns electronic watches; and more particularly electronic watches having non-moving means of control.

Means of control frequently used in electronic watchmaking is an electrical contact actuated by a moving element such as a push button or a crown. This solution necessitates the use of an element which passes through the watch case, which imposes design limitations, reduces reliability and adds to the cost of fabrication of the product. On the other hand, the number of controls, and therefore the contacts and necessary actuators, is increased with the number of functions available in the watch. The problem of the control of watches having available many functions rapidly becomes critical, for obvious economic and esthetic reasons. It is hardly possible to use more than four control elements. The use of codes, which has surmounted this problem, implies the necessity to memorize an increasingly complex system of manipulation.

The introduction in watches of already well-known capacitive pick-offs or detectors used as control elements has eliminated certain problems posed by moving control elements and has allowed the conception of out of the ordinary means of entering control orders. For example, the system described in communication no. 8 delivered by J. P. JAUNIN on the occasion of the 55th Congress of the Swiss Society of Chronometry in Oct., 1980, using four capacitive pick-offs placed in line, makes possible the changing of the time or the introcution of a wake-up time in a digital watch very simple. To do this, the watch is put into correction mode using an electrical push-button, then the displayed information is modified by passing a fingertip along the centre line of the four capacitive pick-offs mounted either in the watch case or in the watch glass. The numerical value displayed is increased or decreased depending upon the direction of motion of the fingertip, the change being one unit for each passage of the fingertip across a pick-off. A complete stroke passing across the four pick-offs therefore changes the value displayed by four units. Since this stroke can be made rapidly, a correction, even a large one, becomes very easy. The number of pick-offs is limited only by the necessity to have at least three if the direction of the finger stroke is to be detected.

Even though the use of capacitive pick-offs as fundamental means of control has been known for a long time, for example in elevators, televisions and radios, their application in watches is recent. That implies in the beginning that a pick-off should consist of an electrode sufficiently large (approximately the size of that portion of the finger which will activate it) to assure reliable operation and insensibility to industrial parasites. In addition, since this electrode should be mounted on the glass of the watch or on an insulated section of the front face of the watch case, the connection of the electrode to the circuit, which forms a unit with the module, poses difficult design problems.

In order to be able to use pick-offs with a small exposed surface, it is necessary to use sophisticated circuits, capable of reliably detecting the very small capacitance variations resulting from their activation. The Swiss Pat. No. 607872 from The Electronic Horological Centre describes such a circuit in which use is made of the synchronous detection of a voltage applied to the pick-off. The amplitude of the voltage detected varies depending upon whether the pick-off is activated or not. The risk of a false signal in this circuit, due to noise from industrial parasites of 50 and 100 Hz, is diminished as the frequency of the voltage applied to the pick-off is increased. With an applied frequency of approximately 8 kHz and careful fabrication, the functional reliability can be good. The application of the 8 kHz voltage to the pick-off requires, however, additional current, in the neighborhood of the current normally consumed by the circuit of a liquid crystal digital watch.

SUMMARY OF THE INVENTION

The principal object of the present invention is to provide an electronic watch using a non-moving means of control which presents, when compared with capacitive pick-offs, the advantage of being non-sensitive to electrical parasites of all types, of having an extremely small current consumption and being adapted for mounting directly on the watch module.

To attain the stated object, the watch complying with the invention which comprises a timekeeping circuit; means for displaying the time controlled by said circuit; manual control means for supplying control signals to said circuit; and a source of electricity supply to said timekeeping circuit, the means of display and the means of control; is mainly remarkable in that the means of control comprises at least one photo-electric pick-off arranged to receive ambient light and furnishing a signal proportional to the intensity of the said light and thus the lighting of the pick-offs may be manually interrupted to generate said control signal.

The advantage which accrues to the use of a photo-electric pick-off is, the fact that such a pick-off is non sensitive to electrical parasites, the fact that the electrical signal which it supplies requires no electrical energy; this energy being produced by the light received on the sensitive surface of the photo-electric pick-off and, that finally, it can be placed facing a window in the bezel of the watch case, and mounted on the same module as the timekeeping circuit to which it may easily be connected.

Preferably said means of control further include a compensating circuit which receives the signal supplied by the pick-off, said circuit generating said control signals substantially independently of the intensity of the ambient light.

BRIEF DESCRIPTION OF THE DRAWINGS

Further features and advantages of the present invention will be shown in the following desciption taken in conjunction with the accompanying drawings in which.

DETAILED DESCRIPTION OF THE PREFERRED EMBODIMENTS

Figure 1:
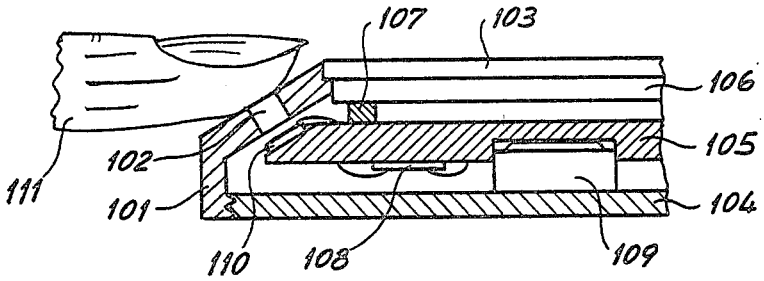
FIG. 1 is a partial schematic view of a watch equipped with a photo-electric pick-off.

FIG. 1 represents schematically a sectional view of a wristwatch case having a bezel 101 provided with a window 102 in the front part, a glass 103 and a back 104. In the interior of the case are shown: a module 105 attached to the bezel by means not shown, a display 106, for example a liquid crystal display, a connector 107 connecting the display to the module, an integrated circuit 108, a battery 109 and a photo-electric detector or pick-off 110 consisting, for example, of a photo-diode or a solar cell, providing an electrical signal in response to the light which it receives.

The pick-off 110 which forms the sensing element of the control, means is mounted facing the window 102, in such a way that it can only receive outside light by means of this window. The pick-off is mounted directly on the module 105 to which it is electrically connected. The ability to mount the photo-electric pick-off directly on the module is an important advantage with respect to control systems using a capacitive pick-off which, when mounted on either the watch case of the watch glass, requires a connection between the pick-off electrode and the module.

Figure 2:
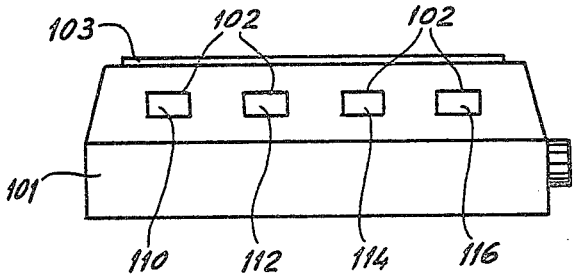
FIG. 2 shows the watch viewed from the side where the windows for the photo-electric pick-offs are installed.

FIG. 2 shows another view of the watch shown in FIG. 1 with the bezel 101, the glass 103 and, in this illustration, four windows identical to window 102 (FIG. 1) behind which are mounted four photo-electric pick-offs 110, 112, 114, 116. Any number of windows and associated pick-offs may be used.

The most frequently used photo-electric pick-off is the photo-diode, also called a solar cell. It consists of a junction formed in a semi-conductor material having a sensitive area of approx. 10 $mm^2$ and having two connections corresponding to its anode and cathode.

Figure 3:
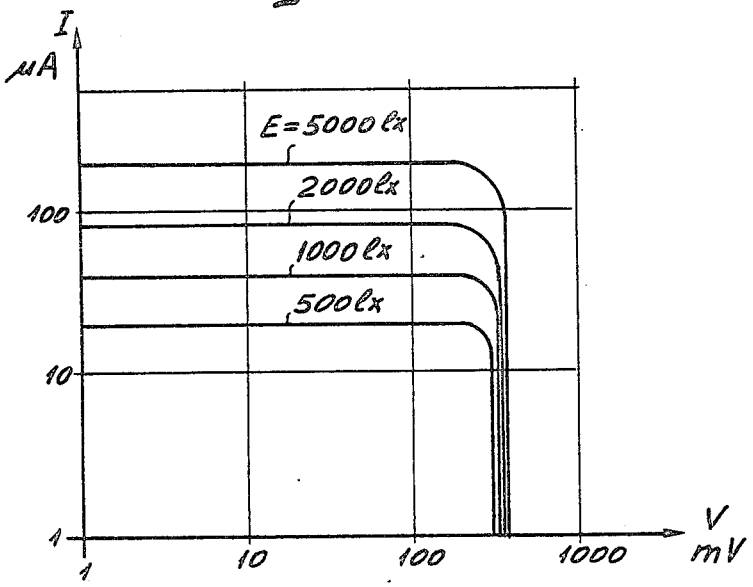
FIG. 3 shows typical characteristics of a photo-diode.

FIG. 3 shows the typical characteristics of a photo-diode. Illustrated is the relationship between the current I passing through the photo-diode when the voltage across the connections of the photo-diode is V and the light intensity E received by the sensitive surface of photo-diode, expressed in lux. If the photo-diode is loaded with a resistance R, the current variation is converted to a voltage variation at least equal to the intrinsic variation produced by the diode when the resistance is of infinite value.

Since a photo-diode is only sensitive to light, another advantage of the present invention with respect to the use of control systems using a capacitive pick-off, is the complete insentivity of a photo-diode to all types of electrical parasitic interference.

If the wearer of the watch obstructs one of the windows 102 with a finger 111 as shown in FIG. 1, the corresponding pick-off passes from the lighted to the obscured state. The resulting signals detected at the connections of the photo-diode serve as the control signals for the watch.

Figure 4:
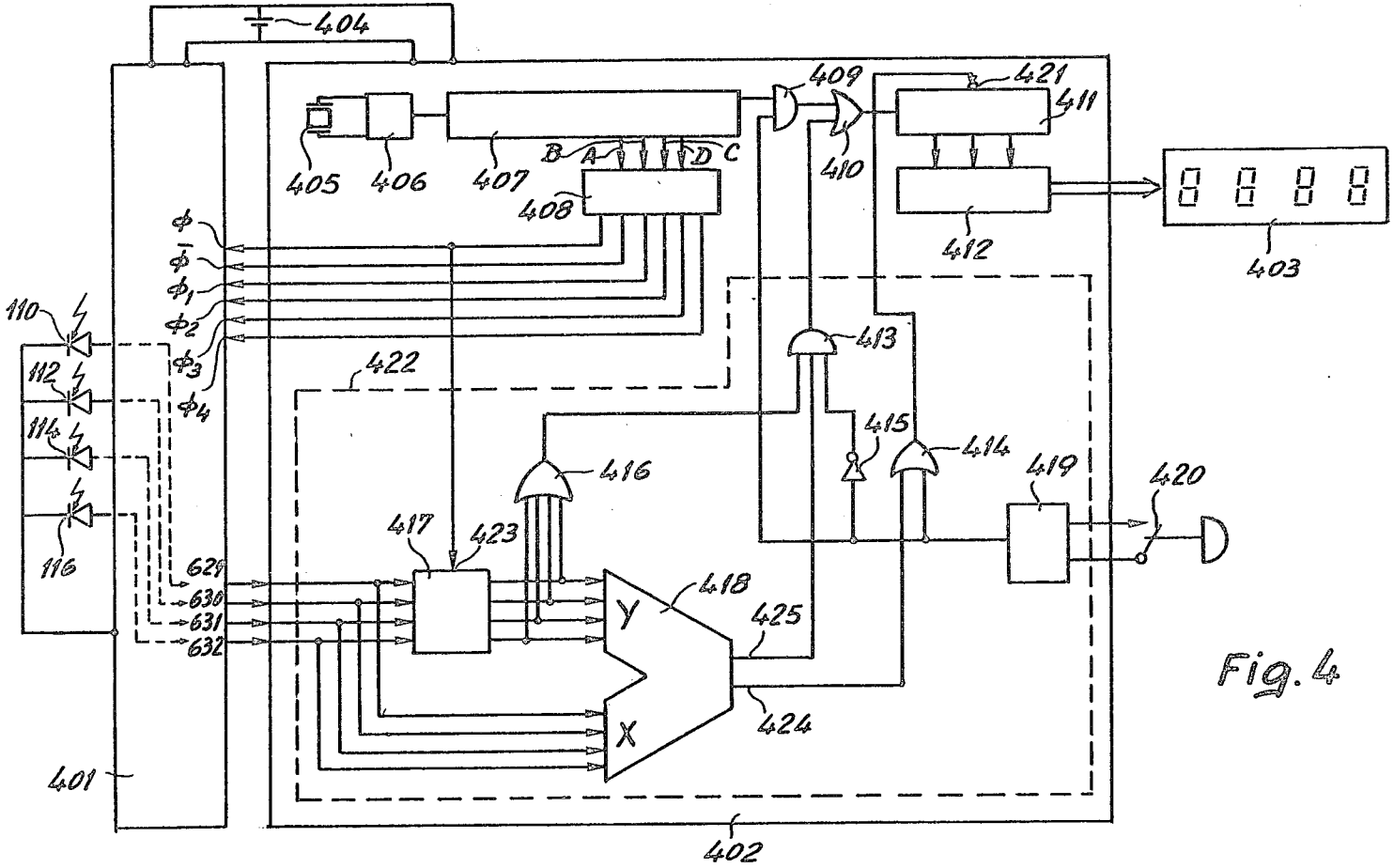
FIG. 4 shows the circuit of a watch equipped with photo-electric control.

FIG. 4 shows a general schematic of a watch complying with the invention. The pick-offs 110, 112, 114 and 116 are connected to a control circuit 401 which will later be described in detail with reference to FIG. 6.

In response to the signal produced by the pick-offs 110, 112, 114 and 116, the control circuit 401 generates logic control signals 629, 630, 631 and 632. These signals appear on the outputs having the same references and are input to a timekeeping circuit 402. When the pick-offs 110, 112, 114 and 116 are obscured, for example with a finger, the control signals 629, 630, 631 and 632 pass to a logic level "high". In the following description "high level" means logic level "high" and "low level" means logic level "low". The timekeeping circuit 402 produces on the one hand logic signal $\phi$, $\bar{\phi}$, $\phi_1$, $\phi_2$, $\phi_3$, $\phi_4$ required for circuit 401, and on the other hand, drives a digital display 403 used to display the time.

The power supply for the circuits 401 and 402 is a battery 404. In addition, an electrical contact 420 operated by a push-button serves as a means of selecting the functional mode of the watch.

The timekeeping circuit 402 will now be described in detail. A quartz resonator 405 is maintained in oscillation by a circuit 406 to provide a time base signal which drives a frequency divider 407. Logic signals A, B, C and D having respective typical frequencies of 128 Hz, 64 Hz, 32 Hz and 16 Hz are derived from the divider 407.

Figure 5:
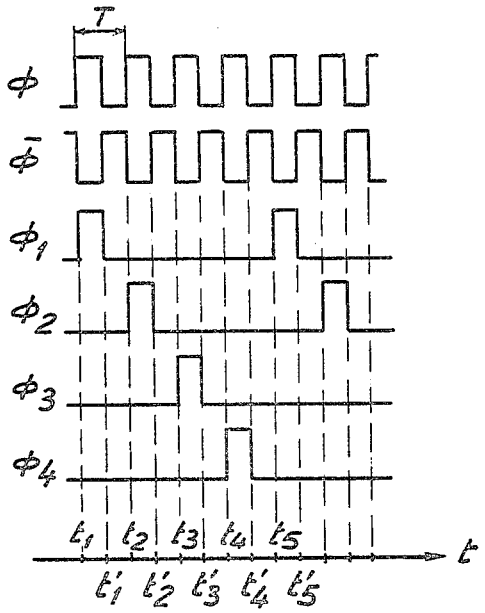
FIG. 5 shows the logic output signals of the principal divider of the watch circuit.

A logic circuit 408 composed of an inverter and AND gates (not shown) produces from signals A, B, C and D the signals $\phi$, $\bar{\phi}$, $\phi_1$, $\phi_2$, $\phi_3$, $\phi_4$ which are shown on the diagram FIG. 5. The square wave signals A and $\phi$ are identical and have a period of 7.8 ms; the signal $\bar{\phi}$ is a signal of opposite phase to signal $\phi$; signal $\phi_1$, a rectangular pulse, has a pulse width of 3.9 ms and a period equal to four times the period of signal $\phi$, that is 31.25 ms; the signals $\phi_2$, $\phi_3$, $\phi_4$ are identical to signal $\phi_1$ except that they run out of phase with $\phi_1$ by one, two and three periods of signal $\phi$ respectively. These logic signals, as will be shown later, are necessary for the function of the control circuit 401 and the number of signals $\phi_1$, $\phi_2$, $\phi_3$. . . $\phi_x$ is equal to the number of pick-offs used.

The output of the divider 407 is connected to one of the inputs of an AND gate 409 whose output in turn is connected to one of the inputs of an OR gate 410. The output of the OR gate 410 is connected to the input of an up-down counter 411. This counter has an input 421 which, depending upon whether it is at logic high or low, determines whether the contents of 411 will be incremented or decremented. A decoder 412 decodes the contents of the counter 411 and the output of 412 drives a seven segment digital display 403. If the logic levels of the remaining inputs of AND gate 409 and OR gate 410 are such that counter 411, whose input 421 is assumed to be at logic level high, receives the output of the divider 407, then the watch operates in conventional fashion indicating the time.

A correction circuit 422 is also incorporated into the timekeeping circuit 402 shown in FIG. 4. It provides the capability to correct the watch time using logic signals 629, 630, 631 and 632 generated by the control circuit 401 in response to the electrical signal furnished respectively by the pick-offs 110, 112, 114 and 116.

The change from the time mode to the correction mode is made using the contact 420 which is connected to a flip-flop 419. Each closure of the contact 420 causes the flip-flop 419 to switch. The time mode of the watch corresponds to a high level at the output of the flip-flop 419, and the correction mode of the watch corresponds to a low level of the flip-flop 419. The output of the flip-flop 419 is connected to one input of a two input OR gate 414, and to the input of a single input inverter 415 and to one input of the AND gate 409. The output of the OR gate 414 is connected to the connection 421 of the counter 411. The output of the inverter 415 is connected to one input of a three input AND gate 413 whose output is connected to one input of the OR gate 410. The control signals 629, 630, 631 and 632 output by circuit 401 are input to a four input - four output memory 417, such as RCA type 4042 memory. The clock input 423 of the memory 417 is controlled by the logic signal $\phi$. At each high level of the signal $\phi$, the information present at the inputs of the memory 417 at this instant is transferred to the outputs of memory 417 and remains stored in memory 417 until the next logic high level signal $\phi$.

The state of the logic control signal 629, 630, 631 and 632 from circuit 401 may be considered, at any instant, as a binary number of four bits in which the logic signal 629 corresponds, for example, to the most significant bit. The binary number present at the inputs of the memory 417 shall be called X and the binary number defined by the state of the outputs of memory 417 at the same instant shall be called Y. The value of Y is thus the same value which X had one clock signal $\phi$ earlier. The inputs and outputs of the memory 417 are connected to a comparator 418, having two four-bit inputs and two outputs 424 and 425, such as RCA type comparator 4063. The output 424 assumes, for example, low level when X is greater than Y and high when X is smaller than Y. This output is connected to one input of the OR gate 414. The output 425, outputs a pulse at the instant when the clock signal $\phi$ appears if X is not equal to Y at this instant. This output is connected to the second input of the AND gate 413. Finally, the four outputs from the memory 417 are also connected to the inputs of an OR gate 416 whose output is connected to the third input of the AND gate 413. The OR gate 416 serves to signal the value zero of the number Y by an output low level.

The functioning of the watch in correction mode is governed by the présence of a low level at the output of flip-flop 419 FIG. 4, obtained by closing the contact 420. One of the inputs of OR gate 414 and AND gate 409 is by consequence carried to low level, whilst one input of AND gate 413 is carried to high level by means of the inverter 415. The AND gate 409 will thus block the output signal from divider 407 and stop the watch. The output of the OR gate 414 allows the counter 411 to be put into the up count or down count state, depending upon whether the output 424 of the comparator 418 is at a logic level high or low.

Consider now the state of the control signals 629, 630, 631 and 632. These signals define the value of the binary number Y. If the pick-offs 110, 112, 114 and 116 all receive the same light level the value of X is equal to zero and after one clock signal the number Y takes the same value. A zero value of Y produces a low level at the output of OR gate 416. The AND gate 413 is now blocked as one of its inputs is connected to the output of OR gate 416. If, for example, the pick-off 112 is obscured by a finger it will generate a signal which will cause the signal 630 from the control circuit 401 to move to a high level. At this instant, the number X changes from value zero to value 0100, whilst at the same instant the number Y remains at zero. The output 425 from the comparator 418 generates a signal, which however does not reach the counter 411, Y being zero ant the AND gate 413 remains blocked. One clock signal $\phi$ later, Y becomes the same value 0100 as X. The output of OR gate 416 moves to high level, this results in the opening of the AND gate 413. However, since X is equal to Y, no signal appears at the output 425 of the comparator 418.

If the finger is now moved from pick-off 112 to obscure pick-off 114, X changes from 0100 to the smaller value 0010 whilst Y continues at 0100. At the moment when the finger is thus moved to the next pick-off, the number X is smaller than the number Y at the input to comparator 418. A high level thus appears at the output of comparator 418. This high level is passed through OR gate 414 to input 421 of the counter 411, setting the counter in an up-count state. The output 425 of the comparator 418 produces a signal which passes through AND gate 413 and OR gate 410 to cause counter 411 to count up one unit. One clock signal $\phi$ later Y becomes the same value 0010 as X. Moving from pick-off 114 to 116 as already described Y changes from 0010 to value 0001, whilst Y remains at value 0010. This results once again in an up-count of one unit at the counter 411.

On the other hand, if the movement of the finger is made from pick-off 112 to pick-off 110 the number X changes from value 0100 to the higher value 1000, whilst Y remains at the value 01000. Since X is in this case larger than Y, then the output 424 of the comparator 418 moves to low level, putting counter 411 in a down count state. The signal which appears at the output 425 of the comparator 418, in response to the finger movement, will thus cause counter 411 to count down one unit. It must be noted that, for circuit 422 to function correctly when the finger is moved over a series of pick-offs in one continuous movement, the time for the finger to move from on pick-off to the next must be longer than the period of the clock signal $\phi$. Otherwise, if the clock signal remains at a low level during the passage of the finger a new value of X will not be transferred to memory 417.

This description of the functioning of the watch in correction mode has shown that the value indicated by display 403 may be changed up or down by means of a simple finger movement over pick-offs 110, 112, 114 and 116 in one or the other of two predetermined directions.

The control circuit 401 of the FIG. 4, shown in a preferred form in schematic FIG. 6, will now be described in detail.

The purpose of the control circuit 401 is to render the signals which appear at its output independent in large measure of the variations in ambient light level seen by the pick-offs 110, 112, 114 and 116.

Figure 6:
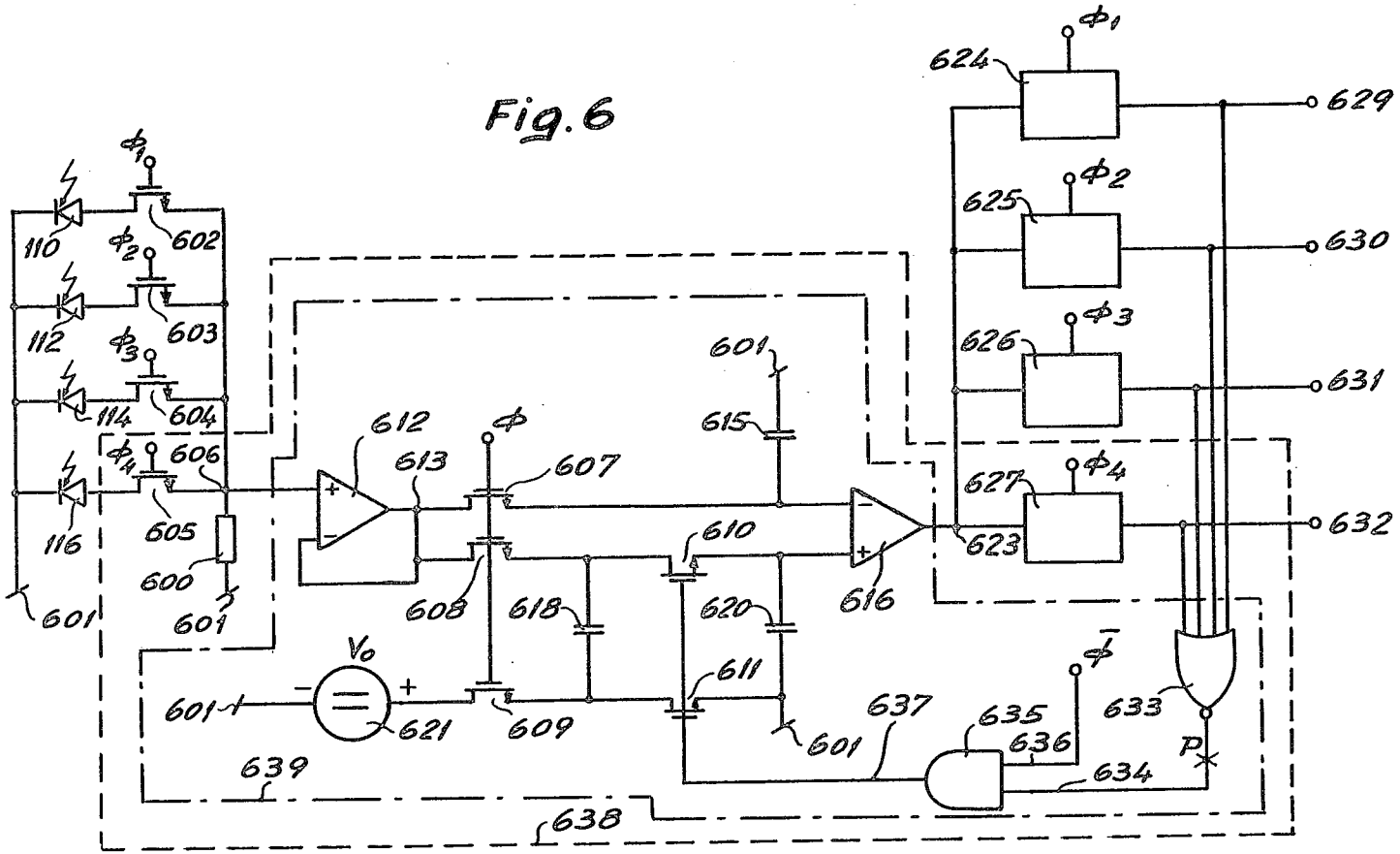
FIG. 6 shows the schematic of one form of the control circuit using photo-electric pick-off.

As shown in FIG. 6, the four photo-diodes 110, 112, 114 and 116 have their cathodes connected to a common ground point 601 and their anodes connected to the respective drains of four transistors 602, 603, 604 and 605. The control electrodes or gates of these transistors are connected to the circuit 401 for respectively receiving the signals $\phi_1$, $\phi_2$, $\phi_3$ and $\phi_4$. These MOS transistors are field effect transistors operating as switches. They are blocked, non conducting or open, when the potential at the gate is equal to or less than the potential at the source. This, for example, means that transistor 602 is open when the potential of signal $\phi_1$ is equal to or less than the potential at point 606. The conducting state is obtained by applying to the gate a potential greater than the potential at the source. Thus these devices behave as switches. A resistor 600 connected between points 601 and 606 allows each pick-off 110, 112, 114 and 116 to operate under load conditions giving the maximum voltage variation at the point 606 for a given variation in light level. The direct input marked + of the differential amplifier 612 is connected to point 606. The reciprocal input of the differential amplifier 612 marked − is connected to the output 613 such that the differential amplifier operates as a unity gain voltage follower having a high impedance input and a low impedance output. Point 613 is also connected to the drains of two MOS transistors 607 and 608 operating as switches. The source of transistor 607 is connected on the one hand to one of the electrodes of a capacitor 615 whose other electrode is connected to ground, and on the other hand to the reciprocal input marked − of a second differential amplifier 616 having a positive gain G. The gain G is chosen sufficiently high to assure that its output 623 will provide two well-defined logic levels.

The source of transistor 608 is connected on the one hand to one of the electrodes of a second capacitor 618 and on the other hand to the drain of a MOS transistor 610 operating as a switch, and whose source is connected on the one hand to one electrode of a third capacitor 620 and on the other hand to the direct input marked + of the differential amplifier 616. A field effect transistor 609 operating as a switch has its drain connected to one of the connections of a generator 621 which supplies a voltage $V_o$. The other connection of this generator is connected to ground 601. The gates of the transistors 607, 608 and 609 are controled by the logic signal $\phi$ from circuit 401. The source of transistor 609 is connected on the one hand to the second electrode of capacitor 618 and on the other hand to the drain of a field effect transistor 611 operating as a switch. The source of this latter transistor 611 and the second electrode of capacitor 620 are together connected to ground 601.

The output 623 of the differential amplifier 616 is connected to the inputs of the four memories 624, 625, 626 and 627 whose clock inputs are connected to circuit 401 so as to receive the logic signals $\phi_1$, $\phi_2$, $\phi_3$ and $\phi_4$ respectively. Each one of these memories stores the logic state present at its input 623 at the instant when its clock input is at logic level high; in addition it produces at its output the stored logic state. On the contrary, when the clock signal is at low level, the output state of the memories is not influenced by the logic state of their input 623.

The outputs of the four memories 629, 630, 631 and 632 are connected to the inputs of a four input NOR gate 633. The output of this gate is connected to the first input of an AND gate 635. The second input is connected to circuit 401 from which it receives logic signal $\bar{\phi}$. The output of the AND gate 635 is connected to the control gates of transistors 610 and 611.

The description of the operation of the control circuit shown in FIG. 6 considers two cases. The first case supposes that all the photo-electric pick-offs receive essentially the same ambient light, which may fluctuate in intensity. The second case examines what happens when one or several of the pick-offs are covered by a finger.

When the pick-offs 110, 112, 114 and 116 are uniformly lighted essentially the same electric signal is present at their connections. Each pick-off is successively and periodically connected to the resistor 600 by means of the switches 602, 603, 604 and 605 controlled respectively by the logic signals $\phi_1$, $\phi_2$, $\phi_3$ and $\phi_4$ as shown in FIG. 5. The successive voltages $V_J$ (J=1 to 4) essentially equal in value, then appear at point 606 of resistor 600. Referring to FIG. 5 it can be seen that at time $t_1$, the logic signals $\phi_1$ and $\phi$ close the switches 602 ans 607 respectively, thus transferring to capacitor 615, through the unity gain amplifier 612, the voltage produced at time $t_1$ at point 606 by the pick-off 110. At time $t_1'$, the switches 602 and 607 open, isolating capacitor 615 which retains its charge until time $t_2$. At this time $t_2$ the signals $\phi_2$ and $\phi$ close in their turn the switches 603 and 607 and the voltage produced at point 606 by pick-off 112 is transferred to capacitor 615.

In the same manner, the logic signals $\phi_3$, $\phi_4$ and $\phi$ transfer to capacitor 615 the voltages produced by the pick-offs 114 and 116 at time $t_3$ and $t_4$ respectively, after which the cycle will restart with logic signals $\phi_1$ and $\phi$ and pick-off 110. The same reasoning applied to capacitor 618 shows that at its connections will be $V_J - V_0$ (J=1 to 4), $V_o$ having a value of several tens of mV at times $t_1$, $t_2$, $t_3$ and $t_4$ due to the closing of switches 608 and 609 whose gates are controlled by the logic signal $\phi$.

For the next portion of the desciption of the functioning of the control circuit of FIG. 6, it is supposed that the input 634 of the AND gate 635 is held at high level after the connection between the AND gate 635 and the NOR gate 633 has been broken at point "P". The output of the AND gate 635 will then be at high level when logic signal $\bar{\phi}$ is applied to input 636 af AND gate 635, that is to say that at times $t_1'$, $t_2'$, $t_3'$ and $t_4'$, as has been shown elsewhere, the switches 608 and 609 are open. At times $t_1$, $t_2$, $t_3$ and $t_4$ the situation is the inverse, the switches 608 and 609 being closed and the switches 610 and 611 open. Thus, during the time intervals from $t_1$ to $t_1'$, $t_2$ to $t_2'$, $t_3$ to $t_3'$ and $t_4$ to $t_4'$, of duration T/2, the capacitor 618 is charged to voltage $V_J - V_o$ (J=0 to 4) whereas during the time intervals from $t_1'$ to $t_2$, $t_2'$ to $t_3$, $t_3'$ to $t_4$ and $t_4'$ to $t_5$ also of duration T/2, the two capacitors 618 and 620 are connected in parallel, This operating mode is the same as a switched capacitor circuit, which is known to simulate a low pass RC filter (see article by J. T. Caves et al. "Sampled Analog Filtering Using Switched Capacitors as Resistor Equivalents". IEEEJ. Solid State Circuits vol. SC-12 Dec. 1977) Giving the designations $C_{618}$ and $C_{620}$ to the capacitances of the capacitors 618 and 620, the time constant of the filter has a value $\tau = T.C_{620}/C_{618}$ for a time constant $\tau$ in the order of 50 ms, where T is approximately 7.8 ms it can be seen that $C_{618}$ should be approximately 10 times smaller than $C_{620}$. The result of this filtering is that the voltage present at the connection of the capacitor 620 is equal to the time averaged voltage $\bar{V}$ of the voltages $V_J - V_o$ produced by the pick-offs in a given condition of ambient light. If the pick-offs are identical and the ambient light level remains fixed or varies slowly with respect to the 32 ms measuring cycle of the four pick-offs and the time constant $\tau$ of 50 ms for the filter, which is generally the case, then $\bar{V}$ is approximately equal to $V_J - V_o$.

In these conditions, the differential amplifier 616 having gain G receives, at its direct imput, the voltage $\bar{V}$ and at its inverted input, voltage $V_J$. Thus the voltage at its output is $G(\bar{V} - V_J) = -GV_o$. This voltage is negative and represents a low level. This low level is transferred to the memories 624, 625, 626 and 627 by the signals $\phi_1$, $\phi_2$, $\phi_3$ and $\phi_4$ at times $t_1$, $t_2$, $t_3$ and $t_4$ respectively. The outputs of these memories 629, 630, 631 and 632 assume at the same times low level, and being connected to the inputs of NOR gate 633 cause a high level to appear at its output. It is precisely this high level which was supposed to exist at the input 634 of the AND gate 635 at the moment when the connection between this input and the output of the NOR gate 633 was cut at point P. This connection between gates 633 and 635 may thus be reestablished without disturbing the functioning of the circuit, which in response to the signals generated by the uniformly lighted pick-offs, provides an average voltage $\overline{V}$ at the connections of capacitor 620, representing the intensity of the ambient light.

The reaction of the circuits shown in FIG. 6 to a very rapid change in ambient light will now be examined. If this variation occurs as an augmentation of the light intensity at time $t_1$ for example, then the voltage $V_J(J=1)$ is increased to a value $V_1'$, whilst the voltage $\overline{V}$ remains constant, since the switches 610 and 611 are open in the time interval $t_1$ to $t_1'$. The output voltage 623 of the amplifier 616 will then be $G(V_1-V_o-V_1')$ and being less than $-GV_o$, it confirms the low level already existing at the inputs of the memories 624, 625, 626 and 627. The circuit therefore continues to function in this case without being disturbed.

On the other hand, if the light intensity is suddenly diminished at time $t_1$, the voltage $V_J(J=1)$ is lowered to $V_1''$ whilst the voltage $\overline{V}$ remains constant. A voltage $G(V_1-V_o-V_1'')$ then appears at point 623. The voltage may be positive and produce a high level at the inputs of the memory 624 if $V_1$ is greater than $V_o+V_1''$. The output 629 of memory 624 takes on the same high level and consequently the NOR gate 633 has three inputs at the same low level and one input at high level. The output of this gate 633 changes to a low level, causing a low level at the output point 637 of the AND gate 635, whatever the logic level of the signal $\phi$ at the input of 636. The result is that the switches 610 and 611 remain open between $t_1'$ and $t_2$ thus blocking the circuit. In effect, the capacitor 620 can no longer be charged to a voltage proportional to the new light level, even after the outputs of the other memories 630, 631 and 632 have changed to a high level. In practice the risk of blocking the circuit is very small because it is possible to choose voltage $V_o$ supplied by the voltage generator 621 so that it will be higher than the variation of $V_1''$ between $t_1$ and $t_1'$. If this condition is not fulfilled, and the circuit is blocked, the voltage $\overline{V}$ at the connections of capacitor 620 diminishes slowly due to the inevitable leakage, allowing the circuit to restart in due course.

The case will now be considered where certain pick-offs shown in FIG. 6 are deliberately obscured, by for example a finger, in order to enter a control signal to the watch. First it will be supposed that pick-off 110 is quickly obscured at $t_1$. The signal generated by this pick-off is lowered and causes a voltage $v_1$ to appear at the connections of resistor 600, switch 602 being closed. This voltage is substantially less than voltage $V_1$ which existed at this point one period of $\phi_1$ earlier when the pick-off 110 was still fully lighted. During the time interval between $t_1$ and $t_1'$ the voltage $v_1$ is transferred to capacitor 615 because the switch 607 is also closed. On the other hand the switches 610 and 611 being open, the voltage $\overline{V}$ at the connections of capacitor 620 equals the voltage which was produced by the full lighting of all the pick-offs, and its value is in fact $V_1-V_o$. The voltages $v_1$ and $V_1-V_o$ being applied to the inputs of the differential amplifier 616, at the output of the differential amplifier 616, at the output of the differential amplifier the positive voltage $G(V_1-V_o-v_1)$ is produced since $V_1$ is normally higher than $V_o+v_1$. This positive voltage being the same as a high level is applied to the input of memory 624 and at the same time the same high level appears at the output 629. The other pick-offs 112, 114 and 116 being fully lighted, a low level corresponding to their fully lighted state appears at the output of differential amplifier 616 and at the same time at the outputs 630, 631 and 632 of the memories 625, 626 and 627 for the same reasons as explained in the case already described when all pick-offs are uniformly lighted. Consequently one of the inputs of the NOR gate 633 is at high level, whereas the other inputs are at low level. This state causes a low level at the output of the gate 633. This output being one of the inputs of AND gate 635, the output of this gate 635 takes on a low level whatever the logic level of $\overline{\phi}$ is at the input 636. Finally, the low level at the output of AND gate 635 puts the switches 610 and 611 in an open state.

From the foregoing the result is, that from the time when pick-off 110 is obscured at time $t_1$ the output 629 of memory 624 moves to high level, the outputs 630, 631 and 632 of the memories 625, 626 and 627 remaining at low level. The switches 610 and 611 open thus isolating capacitor 620, which retains the voltage $\overline{V}$ which corresponds to an ambient light state. The control circuit remains in this state as long as the pick-off 110 is not again exposed to light, or the capacitor 620 is not discharged by leakage sufficiently to allow high level at the outputs 629, 630, 631 and 632.

It must be noted, on the one hand, that the choice of the value of the voltage $V_o$ at generator 621 is the result of a compromise between the risk that the circuit will block as a result of a sudden diminution in ambient light level, as has previously been examined in the case where $V_o$ is too low, and the inconvenience of a loss of sensitivity of the pick-offs if voltage $V_o$ is too high.

In effect, a pick-off is active if the value $G(V_1-V_o-v_1)$ becomes positive. This condition is achieved if $V_1-v_1$ is greater than $V_o$. Thus $V_1-v_1$ defines the sensitivity of the pick-off, which is improved proportionally to the diminution of $V_1-v_1$. The result is that for a pick-off to be active and sensitive the voltage $V_o$ should be small. On the other hand, if the pick-off 110 is obscured at a moment which falls outside the time interval between $t_1$ and $t_1'$ then the circuit does not change state until the next signal $\phi_1$ and the process described will be started at time $t_5$, as is illustrated in FIG. 5, that is to say, with a maximum delay of three and one half periods of signal $\phi$ which is approximately 27 ms.

Finally, if several pick-offs are obscured simultaneously, for example pick-offs 110 and 114, the circuit reacts in a manner analogous to the reaction described when only one pick-off is obscured, with the exception that two memory outputs instead of one memory output are at high level, in fact the outputs 629 and 631, whilst the outputs 630 and 632 remain at low level. In the particular case where all the pick-offs are obscured a high level is produced at all the memory outputs.

To sum up, the functioning of circuit 401 whose outputs 629, 630, 631 and 632 reflect the state of the pick-offs 110, 112, 114 and 116 respectively, which are connected to circuit 401, is as follows. The lighting of a pick-off by ambient light produces a control low level at the corresponding output, whilst when it is obscured, that is to say when it is activated by means of a finger, a control high level is produced at that same output. In addition, the circuit is able to function in a wide range of ambient light levels, due to the continual measurement by the pick-offs of the average ambient light level.

In the description of the functioning of the circuit 401, the state of exposure to light or obscurity of the pick-offs does not change with the passage of time. This is a static operating mode. A dynamic operating mode is also possible. It is the operating mode wherein the finger of the wearer of the watch is moved in a manner which obscures the pick-offs 110, 112, 114 and 116 in a specific order. The only conditions being that the length of time to pass from exposure to obscurity, of the inverse, must be longer than the period of signals $\phi_1$, $\phi_2$, $\phi_3$, $\phi_4$ so that the circuit may react to the change.

In the circuit shown in FIG. 6 there are four pick-offs 110, 112, 114 and 116 to which the outputs 629, 630, 631 and 632 correspond. But it is evident that the circuit can function with only one pick-off. Considering for example pick-off 116 the dotted line 638 in FIG. 6 outlines that part of the circuit and the output 632 which corresponds to pick-off 116. The signals $\phi_1$, $\phi_2$, and $\phi_3$ are not longer necessary and signal $\phi_4$ can be of the same period and the same phase as signal $\phi$ shown in FIG. 5. The NOR gate 633 in this case has only one input the others being considered to be at low level. The function of this gate is thus reduced to that of a NOT gate. The input to a watch of several differing control signals using only one pick-off may only be achieved by using a manipulation code. A decoder circuit such as the one described in the Swiss patent application No. 617059, must then be inserted in the timekeeping circuit 402 of the watch shown in FIG. 4 and it must be connected to the output 632 of the control circuit 401.

It must be noted that in the case where four pick-offs are used, the control circuit may be made up of four circuits 638, one for each pick-off. This implementation is wasteful of components. A different implementation, called multiplexing, has been used in FIG. 6. In the schematic a single circuit 639 may be shared between the pick-offs 110, 112, 114 and 116 and the memories 624, 625, 626 and 627. This circuit is then used sequentially, first to read in succession the information provided by each pick-off, then to treat the information to eliminate the influence of variations in ambient light, and finally to transmit the information to the corresponding memory. This is achieved by connecting, periodically, each pick-off to the common point 606 by means of the switches 602, 603, 604 and 605 which are controlled respectively by the logic signals $\phi_1$, $\phi_2$, $\phi_3$ and $\phi_4$. The same signals also control, in the same order, the memories 624, 625, 626 and 627 which memorise the information which they receive and cause this information to appear as control signals at the outputs 629, 630, 631 and 632.

The arrangement of the pick-offs 110, 112, 114 and 116 in FIG. 6 is connection in parallel, all the cathodes being brought together at ground point 601. This configuration is well adapted to the sequential reading of the signals provided by the pick-offs, since they are processed by multiplexing. In fact, they require only one sampling switch for each pick-off, switches 602, 603, 604 and 605 for pick-offs 110, 112, 114 and 116 respectively.

If the pick-offs are photo-diodes it may be seen in FIG. 3 that the power which they are capable of providing is in the order of several microwatts when the light level is sufficient. This power is in principle sufficient to operate the circuits of the watch, but is only available at each pick-off at approximately 0.5 V in the best case. Such a voltage is too small to permit the recharge of the watch battery 404 shown in FIG. 4.

An arrangement where the pick-offs are connected in series allows a higher voltage to be obtained. It then can be large enough to allow recharging of a battery or an accumulator.

Such an arrangement of pick-offs or detectors and thier associated circuit in a preferred embodiment, will now be described with reference to the schematic shown in FIG. 7. In this design, the cathode of a pick-off 116 is connected to the ground point 601 and the anode is connected to the cathode of pick-off 114. The anode of pick-off 114 is similarly connected to the cathode of pick-off 112. Finally, the anode of pick-off 112 is connected to the cathode of pick-off 110 whose anode 701 thus carries a voltage equal to the sum of the voltages produced by each pick-off. The voltage existing at point 701 is used to recharge the battery 404 using a standard well-known circuit 702, such as the circuit described in Swiss patent application No. 607813. This circuit allows a current limited charge of the battery 404 whilst at the same time preventing discharge of the battery when one or more of the pick-offs are obscured. The circuits 401 and 402 are connected to the battery 404 by a connection 703. The source of a transistor 704 is connected to point 701 and the drain of this transistor is connected to the source of a transistor 705. The drain of transistor 705 is connected to the direct input of the amplifier 612. The source of a transistor 708 is connected to the cathode of pick-off 110 and the drain of this transistor is connected to the source of the transistor 709. The drain of transistor 709 is connected to point 606. The source of a transistor 706 is connected to ground point 601 and the drain of this transistor is connected to the drain of a transistor 707. The source of transistor 707 is connected to the drain of transistor 708. A capacitor 724 connects together the drains of transistors 704 and 707. A resistor 720 connects together the drains of transistors 704 and 708. The source of a transistor 712 is connected to the cathode of pick-off 112, and the drain of this transistor is connected to the source of a transistor 713. The drain of transistor 713 is connected to point 606. The source of a transistor 710 is connected to ground point 601 and the drain of this transistor is connected to the drain of transistor 711. The source of transistor 711 is connected to the drain of transistor 712. A capacitor 725 connects together the drains of transistors 708 and 711.

A resistor 721 connects together the drains of transistors 708 and 712. The source of a transistor 718 is connected to the cathode of the pick-off 114 and the drain of this transistor is connected to the source of a transistor 719. The drain of transistor 719 is connected to point 606. The source of a transistor 714 is connected to ground point 601, and the drain of this transistor is connected to the drain of a transistor 715. The source of transistor 715 is connected to the drain of transistor 718. A capacitor 726 connects together the drains of transistors 712 and 715. A resistor 722 connects together the drains of transistors 712 and 718. A capacitor 727 connects the drain of transistor 718 to the ground point 601. The gates of transistors 704, 707, 708, 711, 712, 715 and 718 are all controlled by the logic signal $\bar{\phi}$. Similarly the gates of transistors 705 and 706 are controlled by the logic signal $\phi_1$, the gates of transistors 709 and 710 by logic signal $\phi_2$, the gates of transistors 713 and 714 by logic signal $\phi_3$ and the gate of tansistor 719 by the logic signal $\phi_4$. The form of the logic signals $\overline{\phi}$, $\phi_1$, $\phi_2$, $\phi_3$ and $\phi_4$ is as shown in FIG. 5 and their amplitude is assumed to be sufficient to cause each transistor to function as a switch, in the same manner as the transistors found in the schematic FIG. 6. The use of a voltage multiplier circuit is necessary to achieve the amplitude required of these signals. This voltage multiplier circuit is not shown in FIG. 7 but its design is well known and it may be incorporated in the watch circuit 402. The resistors 720, 721, 722 and 723 act as loads for the pick-offs and render superfluous the single load resistor 600.

The functioning of the circuit shown in FIG. 7 will be described, firstly by considering how the signal from, for example, pick-off 112 is transmitted to the amplifier 612. Referring to the logic signal diagram FIG. 5 it can be seen that, at time $t_1'$ the signal $\overline{\phi}$ moves to high level, while logic signal $\phi_2$ is at low level. The switches 708, 711 and 712 change from the open state to the closed state, whilst the switches 709 ant 710 remain open, the logic signal $\phi_2$ being at low level. The voltage at the connections of pick-off 112 is thus applied to capacitor 725. The load resistor 721 allows the voltage at the connections of the pick-off to be optimised as a function of the light variation. At the time $t_2$ the logic level of $\overline{\phi}$ moves to low level and that of $\phi_2$ moves to high level. The switches 708, 711 and 712 open and isolate the capacitor 725, which is charged to the voltage produced by pick-off 112. The switches 709 and 710, on the other hand, close. The switch 709 puts one of the electrodes of capacitor 725 to ground point 601, whilst the switch 709 transmits the voltage at the other electrode to input 606 of the amplifier 612.

Figure 7:
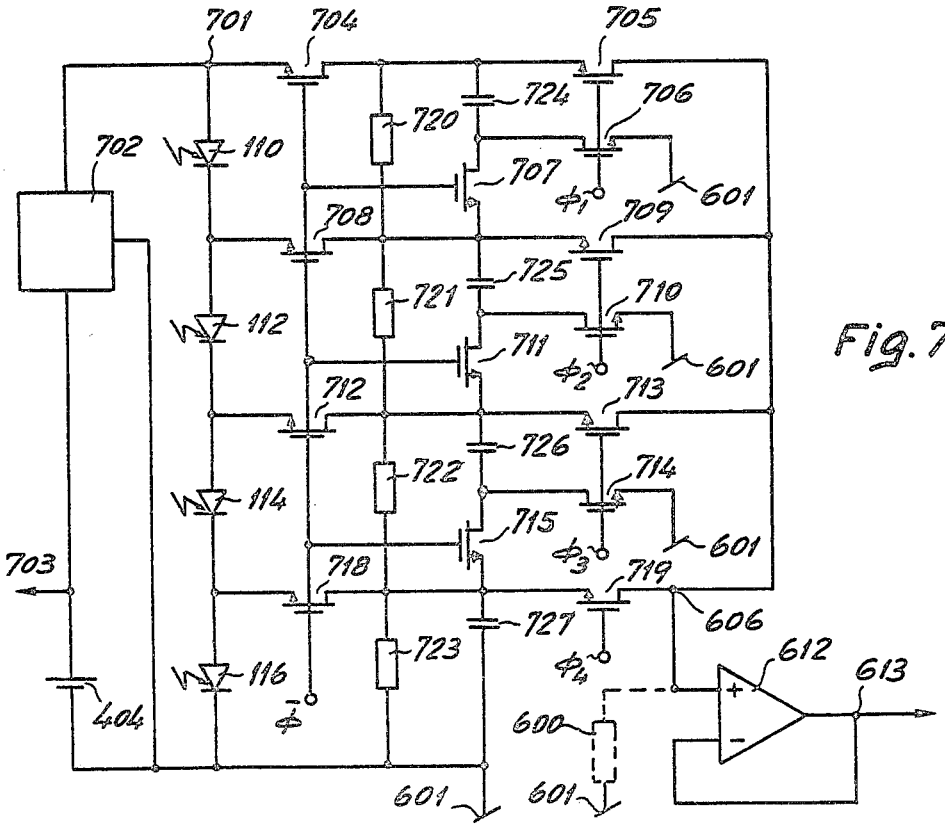
FIG. 7 shows the schematic of another embodiment of the control circuit using pick-offs connected in series to enable the recharging of the watch battery.

Considering now the circuit shown in FIG. 7 as a whole, it can be seen that at each high level of logic signal $\overline{\phi}$ the capacitors 724, 725, 726 and 727 are charged to the voltages produced by pick-offs 110, 112, 114 and 116 respectively. The voltage are transferred in sequence, and in the same order, to amplifier 612 by means of logic signals $\phi_1$, $\phi_2$, $\phi_3$ and $\phi_4$. These voltages are then treated by the circuit shown in FIG. 6 in the same manner as when the four pick-offs are connected in parallel.

Figure 8:
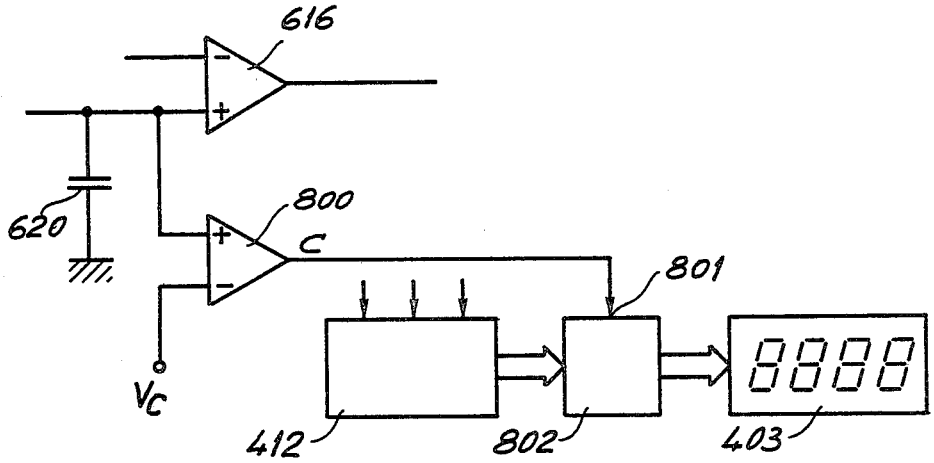
FIG. 8 shows one variation of the control of the watch display.

In the case shown in FIG. 4 where the watch uses a digital display (liquid crystal) the control circuit 401 may be used to carry out another function, for automatically disconnecting the display 403 in order to economize on current consumption, when the ambient light level is too low. FIG. 8 shows a possible modification to control circuit 401 to put this function into operation.

In FIG. 8 are shown the amplifier 616 and the capacitor 620 previously shown in FIG. 6 and which as has been described memorize the average voltage $\overline{V}$ which represents the intensity of the ambient light. Added to the circuit is a differential amplifier 800 connected as a comparator. The direct input to this amplifier, marked +, is connected to the direct input of differential amplifier 616, thus it receives the voltage $\overline{V}$. The inverted input of differential amplifier 800 marked − receives a reference voltage $V_c$. The value of $V_c$ corresponds to the threshold of light level at which the display is no longer readable. The amplifier 800 produces a logic signal C at high level if $\overline{V}$ is greater than $V_c$ and at low level if $\overline{V}$ is less than $V_c$.

The signal C is applied to the control input 801 of a circuit 802 inserted between the decoder 412 and the display 403. Circuit 802 functions as a switch, constructed in known fashion using MOS transistors or transmission gates, which cut-off the driving signals to the display when signal C is at low level.

In other methods of construction the circuit 802 may be inserted between the display 403 and its source of power battery 404. In addition, the display 403 may be made up from any passive electro-optic display element, such as a liquid crystal display.

Returning to FIG. 4, it can be seen that the timekeeping circuit 402 comprises a circuit for producing time of day information from the time base circuits 405 and 406 and a divider circuit 407 which delivers to the display 403 the pulses necessary to enable the display to show time of day. In addition, circuit 402 comprises a circuit 422 which in response to control signals, provides the information necessary to modify the information displayed by the display 403 when a function other than the time of day function is selected by the wearer of the watch. Shown in FIG. 4 is a means of selecting the correction time of day function, which is found in all watches, this by means of a simple switch 420 which permits the selection of time of day or time of day correction functions.

However, a watch may have other functions than the correction function. It is necessary that the selection circuit be able to control the selection of these functions. These functions may be for example the display of date or day.

In the example of a watch circuit shown in FIG. 4, the logic signals 629, 630, 631 and 632 from the control circuit 401, are treated by the timekeeping circuit 402 so as to furnish information on the direction of motion of a finger moving to obscure the pick-offs, and in addition to furnish information on how many pick-offs the finger has obscured. Thus the pick-offs may be considered as an analog of a roller whose direction and angle of rotation are detected.

Figure 9:
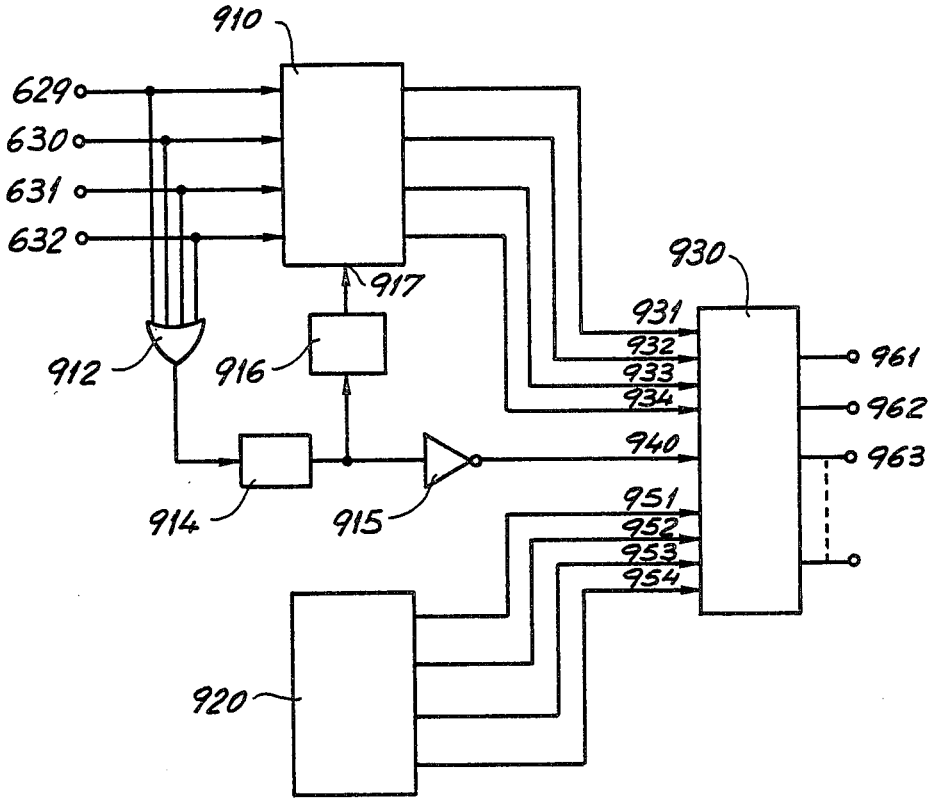
FIG. 9 shows a circuit for the selection of the function mode of the watch.

FIG. 9 shows an alternate means of using signals 629, 630, 631 and 632 to provide a selector circuit. The object of this arrangement is to obtain a coded selection signal, which allows the selection of a given function of the timekeeping circuit 402. This code is defined by the obscuring of one or more of the pick-offs in a defined order. For example, a precise signal will be encoded when pick-offs 110 and 116 are obscured one after the other and another signal will be encoded if pick-offs 110, 114 and 116 are obscured one after the other. When a rank is attributed to each pick-off, a corresponding binary number may be had. In other words, a code corresponds to a predetermined configuration of the control signals 629 to 632 which appears at the outputs of the circuit 401. In the first case, for example, the binary number is 1001 and in the second case the binary number is 1011. In order to avoid confusion, the codes generated by obscuring the pick-offs with a finger and which correspond to a function desired, as described in the foregoing, selection codes furnished by obscuring pick-offs which are mutually adjacent should not be used. For example, the codes 1100 and 0111 are to be avoided.

To achieve this object, the selection signal which the user enters by means of the pick-offs is compared with the group of instructions which the watch is capable of recognizing. Each instruction corresponds to a particular functional mode of the watch. If the signal is recognized, an order corresponding to the instruction chosen is transmitted to the timekeeping circuit 402 which in its turn selects the desired functional mode. To give an example FIG. 4 may be used. The contact 420 whose function is to trigger the flip-flop 419 each time it is closed, causes the watch to change from the indication of time of day mode to the correction mode and the inverse. This function of contact.420 may also be carried out by applying to the input of the flip-flop 419 a pulse which triggers the flip-flop each time pick-off 110 is obscured.

The selection circuit is illustrated for example in FIG. 9. It consists of a first 4 bits SET-RESET memory 910 which receives at its inputs the signals 629, 630, 631 and 632 output by the circuit 401. These same outputs from circuit 401 are connected to the four inputs of an OR gate 912. The output of this gate is connected to the input of a retriggerable monostable circuit 914 having a time constant $\tau_1$.

A transition from low level to high level at the input of monostable circuit 914 causes a high level to appear at its output during a time delay $\tau_1$. The output of the monostable returns to logic level after a time delay $\tau_1$. If the input changes from logic low level to high level when the output is still at high level an additional time delay $\tau_1$ will be added. The time delay $\tau_1$ corresponds to the time required for a finger to pass slowly from one pick-off to another. The output of the monostable circuit 914 is connected on the one hand to the input of inverter 915 and on the other hand to the input of a second monostable circuit 916. A transition from high level to low level at the input of the second monostable circuit 916 also produces a high level at its output; the output maintains its state during a time delay $\tau_2$ which is much shorter than $\tau_1$, after time delay $\tau_2$ the output changes to low level. The output of the monostable circuit 916 is connected to the reset input 917 of memory 910. A read only memory 920 contains the selection codes for the different functions of the watch. The outputs of this memory are connected to the inputs 951, 952, 953 and 954 of a read only memory decoder 930. To the inputs 931, 932, 933 and 934 of memory 930 are connected the outputs from memory 910. Finally, the enabling input 940 of memory 930 is connected to the output of the inverter 915. Memory 930 has a number of outputs 961, 962, 963, etc. which correspond to the capacity of memory 910 and of memory 920 which are similar. The memory 930 by decoding can compare the state of the outputs of memory 910 with the different states stored in memory 920, each of which corresponds to a selection code. When a match is found and when at the same time the enabling input 940 changes to high level one or several of the outputs 961, 962, 963, etc. will change to high level. On the other hand, if the state of memory 910 does not match any of the states stored in memory 920 a low level appears on all the outputs of memory 930. In addition, if the enabling input 940 of memory 930 is at low level, the outputs of memory 930 are not changed by the state of the inputs.

The functioning of the circuit shown in FIG. 9 is now described. Initially the inputs 629 to 632 and the outputs of citcuits 912, 914 and 916 are considered at low level. The outputs of memory 910 are at low level. The enabling input 940 is at high level corresponding to the output of inverter 915. The outputs 961, 962, 963 . . . etc. of memory 930 are also in the state corresponding to the last selection.

If it is now desired to enter into the watch a new mode selection, by, for example, obscuring pick-offs 110 and 116 which corresponds to the code 1001, Istarting with the pick-off 110 which changes the input 629 to high level. The outputs of the OR gate 912 and the monostable circuit 914 changes to high level. The memory 910 stores the binary number 1000.

The finger now leaves pick-off 110 to move to obscure pick-off 116. During this operation the input 629 changes to low level and the input 632 changes to high level. The memory 910 hence stores the binary number 1001 which corresponds to successive obscurings of pick-offs 110 and 116. The output of the OR gate 912 changes from high level to low level then returns to high level during the input of the selection code. Then when the finger is removed from the pick-offs, all the inputs 629, 630, 631 and 632 return to low level, and also the output of the OR gate 912 returns to low level. The output of the switch 914 then changes to low level and the input 940 of memory 930 changes from low level to high level, after time delay $\tau_1$. During the transition of the enabling input 940 at high level, the memory 930 decodes the selected code, and produces a high level at one of the outputs 961, 962, 963, etc. which is then used as a control signal by circuit 402. The transition from high level to low level of the circuit 914 sets the output of circuit 917 at high level during a time delay $\tau_2$. After this time delay $\tau_2$ the output returns to low level. This transition resets the memoriy 910 and puts all its output at low level.

What is claimed is:

1. An electronic watch comprising:

a case having a transparent window therein;

photo-electric sensing means located behind said transparent window, within said case, and operably positioned to receive ambient light for producing control signals when said window is obstructed by a finger or the like;

a timekeeping circuit connected to receive said control signals;

time display means controlled by said timekeeping circuit; and a source of electrical power for energizing said timekeeping circuit, said display means and said sensing means.

2. The electronic watch of claim 1, wherein said photo-electric sensing means comprises one photo-electric detector having a sensitive area for producing an output signal representative of the intensity of the light falling on said sensitive area and means responsive to said output signal for generating said control signals.

3. The electronic watch of claim 2, wherein said generating means comprises a compensating circuit responsive to said output signal for supplying said control signals in a manner substantially independent of the intensity of the ambient light.

4. The electronic watch of claim 3, wherein said compensating circuit comprises:

means for providing a signal representative of the average value in time of the output signal delivered by said detector, and means for comparing periodically said output signal with said average signal in order to provide a control signal when the difference between the value of said output signal and said average signal is greater than a predetermined value.

5. The electronic watch of claim 4, wherein said providing means comprises a switched capacitor low pass filter.

6. The electronic watch of claim 1, wherein said photo-electric sensing means comprises a plurality of photo-electric detectors having sensitive areas individually obstructable, each detector delivering an output signal representative of the intensity of the light falling on the sensitive area thereof, and means responsive to said the output signals for generating said control signals.

7. The electronic watch of claim 6, wherein said generating means comprises compensating means responsive to said output signals for supplying said control signals in a manner substantially in dependent of the intensity of the ambient light.

8. The electronic watch of claim 7, wherein said compensating means comprises: means for providing a signal representative of the average value of said output signals and means for sequentially comparing each of said output signals with said average signal in order to provide a control signal when the difference in level between said output signals and said average signal is greater than a predetermined value.

9. The electronic watch of claim 6, 7 or 8, wherein said photoelectric detectors are photo-diodes which are connected in series.

10. The electronic watch of claim 9, further comprising means directly connected to the connections of said photo-diodes for recharging said power source.

11. The electronic watch of claim 4 or 8, wherein said time display means comprises a passive electro-optical display, and further including means for supplying a reference value representative of a given ambient light level and means for comparing the level of said average signal to said reference value in order to provide an interrupting signal in reply to said comparison and means for cutting-off the power supplying of said time display in response to said interrupting signal.

12. The electronic watch of claim 6, 7 or 8, further comprising means for selecting one among a plurality of functions including actual time display, and wherein said photo-electric detectors are disposed so that said sensitive areas therof can be swept in a first or a second sense; and said timekeeping circuit comprises means for generating an actual time signal in order to display actual time data, and means for elaborating instructions in order to modify the displayed data in response to said selecting means and said instruction, said instruction elaborating means comprising means responsive to said control signal for detecting said first or second sweeping sens of said detectors in order to elaborate a first information representative of said sweeping sense, and means responsive to said control signal for detecting the number of obstructed detectors in the same sense of sweeping in oder to elaborate a second information representative of said number and means responsive to said first and second informations for producing said instructions.

13. The electronic watch of claim 6, 7 or 8 further comprising means for selecting one among a plurality of functions including actual time, said selecting means comprising means for memorizing a plurality of predetermined control signal configurations, each configuration being associated with one of said functions, means responsive to said control signals for comparing said control signal with said predetermined configurations and means for generating selection function signal in response to said comparison.

* * * * *